US008887949B2

(12) United States Patent
Tuan

(10) Patent No.: US 8,887,949 B2
(45) Date of Patent: Nov. 18, 2014

(54) FOLDABLE FOOD CONTAINER

(71) Applicant: Ronald Tuan, Nantou County (TW)

(72) Inventor: Ronald Tuan, Nantou County (TW)

( * ) Notice: Subject to any disclaimer, the term of this patent is extended or adjusted under 35 U.S.C. 154(b) by 0 days.

(21) Appl. No.: 14/051,641

(22) Filed: Oct. 11, 2013

(65) Prior Publication Data

US 2014/0110422 A1 Apr. 24, 2014

(30) Foreign Application Priority Data

Oct. 19, 2012 (TW) ..... 101220170 U

(51) Int. Cl.

| | |
|---|---|
| ***B65D 43/04*** | (2006.01) |
| ***B65D 45/18*** | (2006.01) |
| ***A45C 13/10*** | (2006.01) |
| ***A45C 11/20*** | (2006.01) |

(52) U.S. Cl.

CPC ..... *B65D 45/18* (2013.01); *A45C 13/1084* (2013.01); *A45C 11/20* (2013.01)

USPC ..... 220/799; 220/326; 220/784

(58) Field of Classification Search

USPC ..... 220/4.21, 287, 326, 784, 787, 793, 799, 220/801

See application file for complete search history.

(56) References Cited

U.S. PATENT DOCUMENTS

| | | | | |
|---|---|---|---|---|
| 4,412,630 | A * | 11/1983 | Daenen | 220/792 |
| 4,741,452 | A * | 5/1988 | Holzkopf | 220/783 |
| 6,260,729 | B1 * | 7/2001 | Mitchell et al. | 220/287 |
| 6,666,348 | B2 * | 12/2003 | Fore et al. | 220/4.21 |
| 2009/0289074 | A1 * | 11/2009 | McNamara | 220/780 |

* cited by examiner

*Primary Examiner* — Fenn Mathew

*Assistant Examiner* — James N Smalley

(74) *Attorney, Agent, or Firm* — Banger Shia

(57) ABSTRACT

A foldable food container includes a container body which is made of silicone material and formed with a receiving chamber and an upper open end, and a cover which is engaged on the top peripheral edge cover. A reinforced frame is built in a top peripheral edge of the open end of the container body, and on the top peripheral edge is provided at least one elastic nip portion. The reinforced frame is located below the peripheral edge of the cover, and a peripheral edge of the cover is engaged in the at least one nip portion of the top peripheral edge and pushed against the top peripheral edge of the container body by the nip portion, so that the open end of the contain body is sealed with the cover in an airtight manner.

3 Claims, 6 Drawing Sheets

FOLDABLE FOOD CONTAINER

BACKGROUND OF THE INVENTION

1. Field of the Invention

The present invention relates to a food container, and more particularly to a foldable food container.

2. Description of the Prior Art

As shown in FIGS. 5 and 6, a conventional foldable food container comprises a cover 91 and a container body 90. The peripheral wall 92 around the open end of the container body 90 is formed with an engaging groove 920 for engaging with a frame 93 which is provided with a connecting portion 930. The cover 91 is provided with a peripheral engaging portion 94. When the container body 90 is sealed with the cover 91, the peripheral engaging portion 94 will be engaged with the connecting portion 930, and the inner peripheral edge 910 of the cover 91 will be closely pressed against the top edge 921 of the peripheral wall 92, so that the food container is sealed in an airtight manner.

However, this conventional foldable food container still suffers from the following disadvantages:

Firstly, the container body 90 and the frame 93 are assembled in such a manner that the frame 93 is engaged in the engaging groove 901 of the container body 90, and the cover 91 should be provided with the engaging portion 94 in order to engage with the connecting portion 930. Therefore, the die for forming the container body 90 has to be designed with corresponding part for forming the engaging groove 901, and the cover 91 also has to be designed with a corresponding part for forming the engaging portion 94, which makes the die complicated and increases manufacturing cost. After the container body 90 is formed, it has to manually assemble the frame 93 on the peripheral wall 92 of the container body 90, which further increases the assembling cost.

Secondly, the food container is difficult to clean since greasy dirt is very likely to accumulate between the frame 93 and the engaging groove 901, and it has to remove the frame 93 from the container body 90 in order to clean the food container.

The present invention has arisen to mitigate and/or obviate the afore-described disadvantages.

SUMMARY OF THE INVENTION

The primary objective of the present invention is to provide a simply structured and low-cost foldable food container which is free of the abovementioned disadvantages.

To achieve the above objective, a foldable food container in accordance with the present invention comprises: a container body and a cover.

The container body is foldable and made of silicone material and formed with a receiving chamber which has an upper open end, a reinforced frame being built in a top peripheral edge of the open end of the container body, and on the top peripheral edge being provided at least one elastic nip portion.

The cover is engaged on the top peripheral edge and has a width larger than a width of the open end in such a manner that the reinforced frame is located below the peripheral edge of the cover, and the peripheral edge of the cover is engaged in the at least one nip portion of the top peripheral edge and pushed against the top peripheral edge of the container body by the at least one nip portion, so that the open end of the contain body is sealed with the cover in an airtight manner.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Referring to FIGS. 1-4, a foldable food container in accordance with the present invention comprises: a container body 1 and a cover 2.

Figure 2:
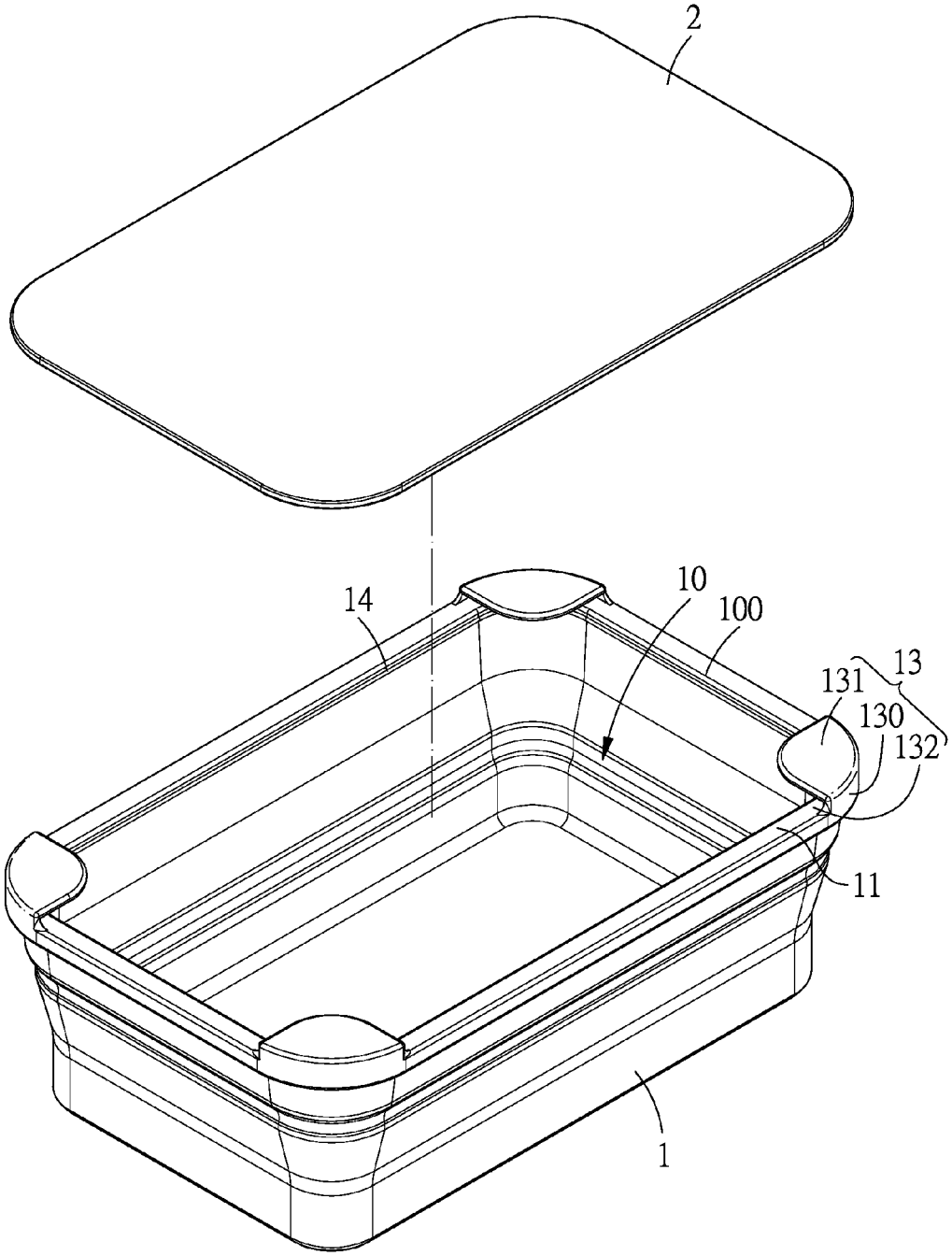
FIG. 2 is an exploded view of the foldable food container in accordance with the present invention.
Figure 3:
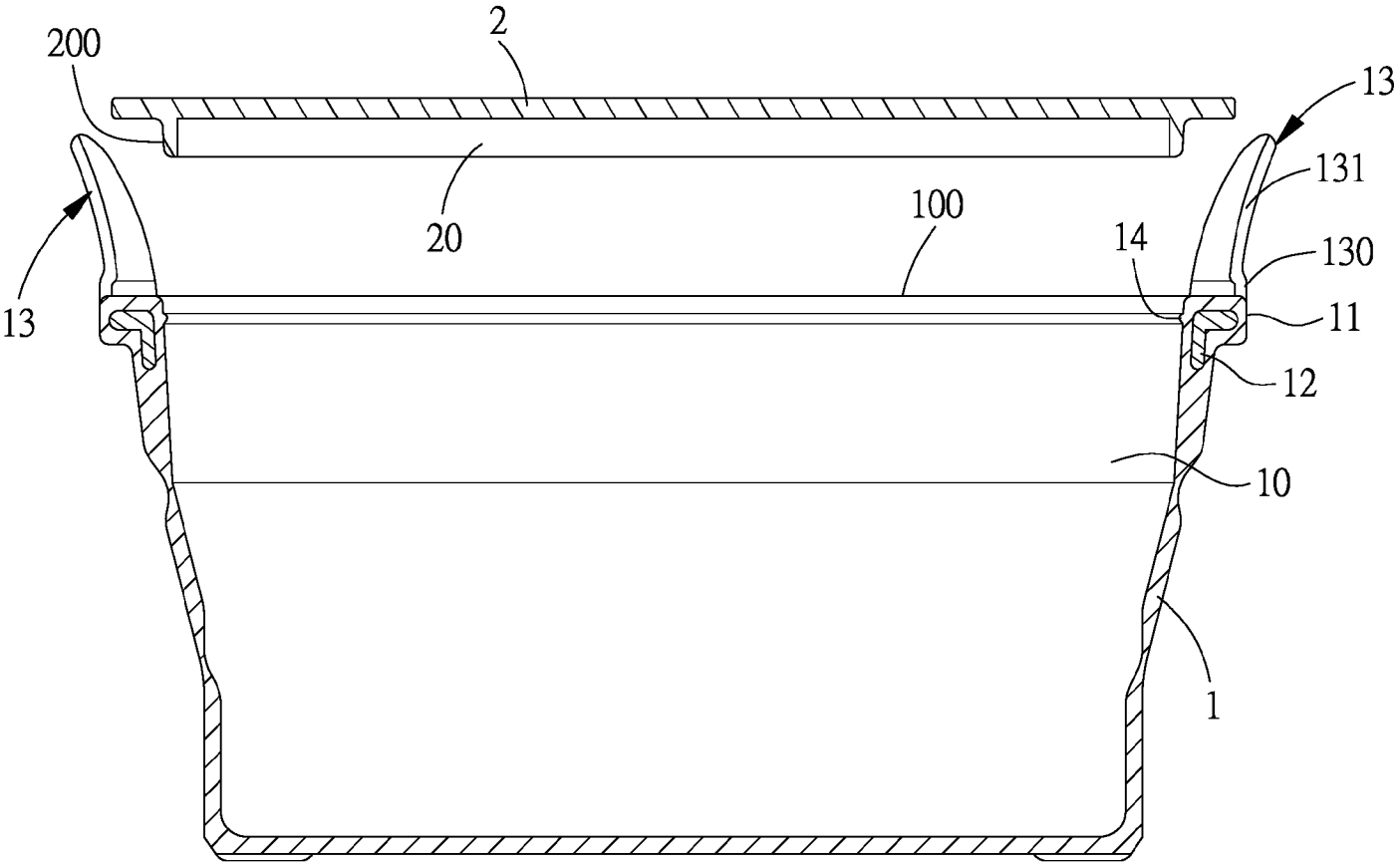
FIG. 3 is a cross sectional view of the foldable food container in accordance with the present invention, wherein the cove is removed from the container body.

The container body 1, as shown in FIGS. 2 and 3, is foldable and made of silicone material and formed with a receiving chamber 10 which has an upper open end 100. A reinforced frame 12 is built in a top peripheral edge 11 of the open end 100 of the container body 1, and on the top peripheral edge 11 is provided at least one nip portion 13.

The width of the cover 2 is larger than the width of the open end 100 so as to engage on the top peripheral edge 11, the reinforced frame 12 hidden in the top peripheral edge 11 is located below the peripheral edge of the cover 2, and the peripheral edge of the cover 2 is engaged in the nip portion 13 of the top peripheral edge 11.

Figure 1:
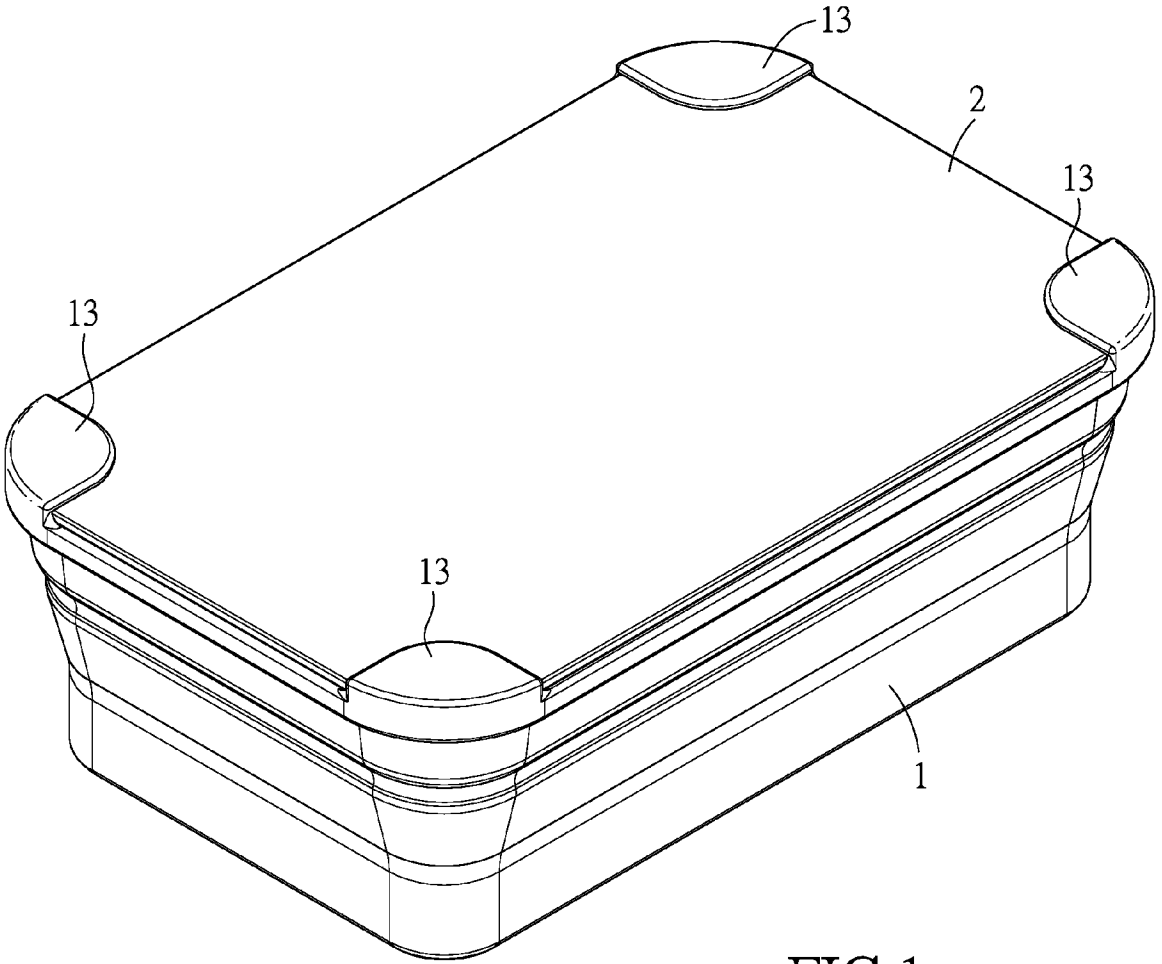
FIG. 1 is an assembly view of a foldable food container in accordance with the present invention.

As shown in FIGS. 1 and 2, the container body 1 of the present invention is rectangular, and at each of four corners of the top peripheral edge 11 of the container body 1 is formed a nip portion 13 which includes a root portion 130 and a clamp piece 131. The root portion 130 protrudes out of the top peripheral edge 11, and the clamp piece 131 horizontally extends from the root portion 130 toward the open end 100. A space 132 is formed between the clamp piece 131 and the top peripheral edge 11 for insertion of the cover 2, and the height of the space 132 is smaller than the thickness of the cover 2, so that the cover 2 will be pressed closely against the top peripheral edge 11 when received in the space 132.

Figure 4:
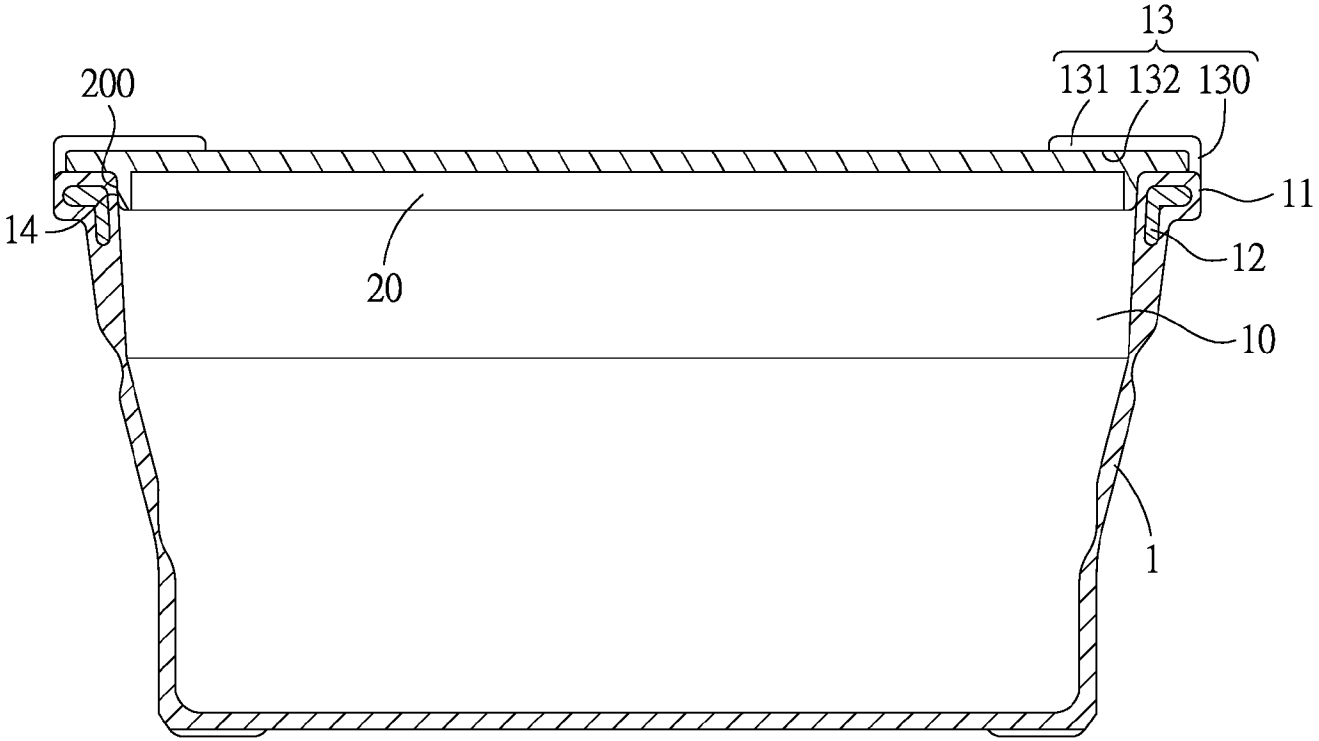
FIG. 4 is a cross sectional view of the foldable food container in accordance with the present invention, wherein the cove is assembled onto the container body.
Figure 5:
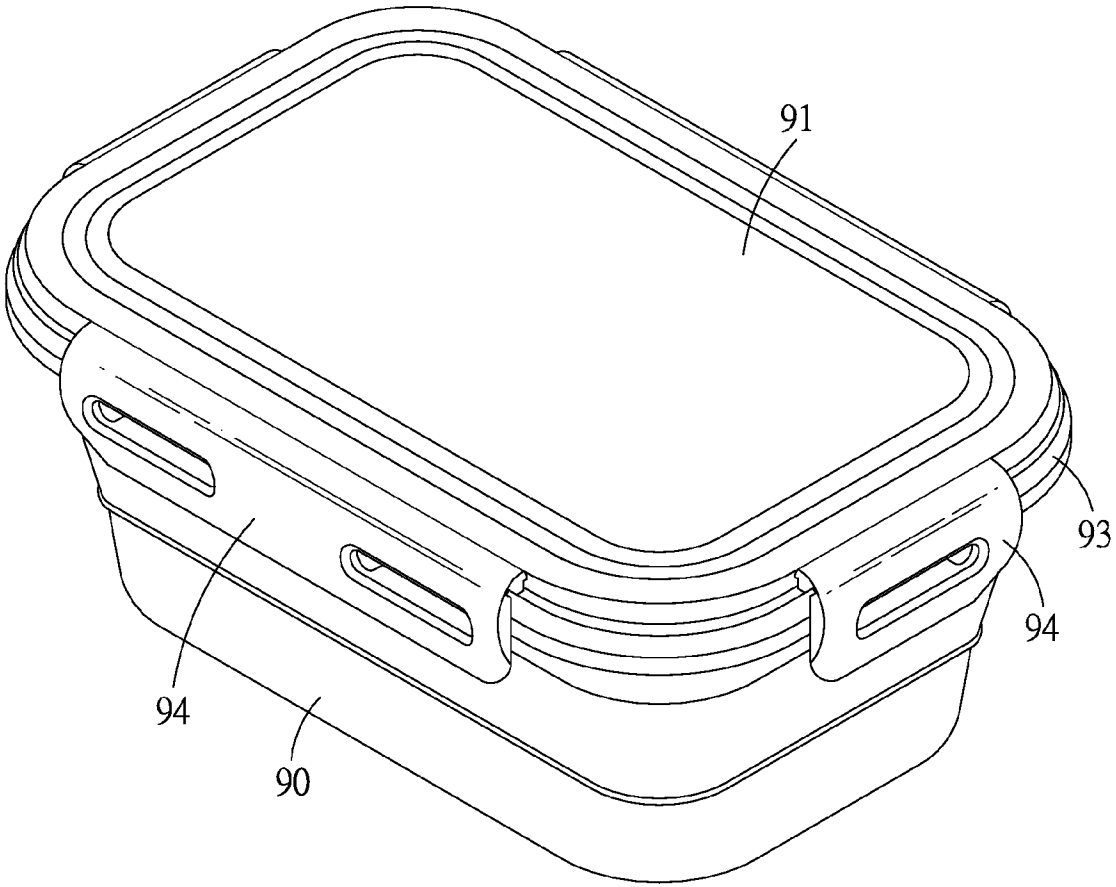
FIG.5 PRIOR ART
FIG. 5 is a perspective view of a conventional food container.
Figure 6:
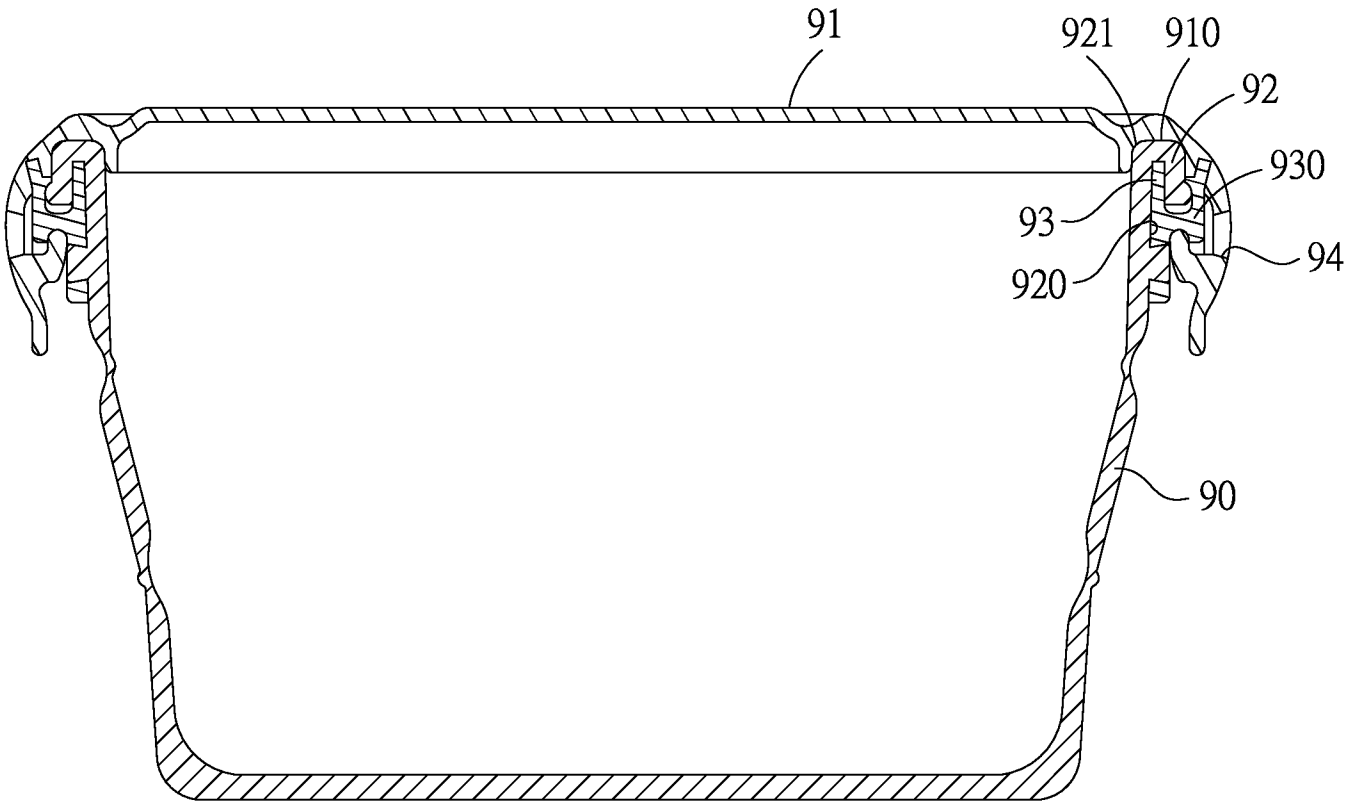
FIG.6 PRIOR ART
FIG. 6 is a cross sectional view of the conventional food container.

As shown in FIGS. 3 and 4, an annular wall 20 extends from the bottom of the cover 2 and is formed to fit in the open end 100 of the container body 1. The container body 1 is provided adjacent the open end 100 with an annular protrusion 14 which protrudes toward the receiving chamber 10 and is made of silicone material.

When the cover 2 covers the container body 1, the peripheral edge of the cover 2 will be closely pressed against the top peripheral edge 11 of the container body 1 by the nip portion 13 due to the fact that, with the elasticity of the root portion 130, the clamp piece 131 will be pulled back to press against the cover 2 when it is pulled upward. When the cover 2 covers the open end 100 of the container 1, the annular wall 20 will insert into the open end 100, and the annular protrusion 14 will be pushed by an outer edge 200 of the annular wall 20 and deforms, so that the open end 100 of the receiving chamber 10 is airtightly sealed. Meanwhile, the reinforced frame 12 fixes the shape of the top peripheral edge 11 of the container body 1, ensuring that the cover 2 can be airtightly assembled to the open end 100.

The foldable food container in accordance with the present invention processes the following advantages:

1. as compared to the structure of the engaging portion 94 and the connecting portion 930 of the frame 93 of the conventional food container, the structure of the top peripheral edge 11 of the container body 1 is relatively simple since the reinforced frame 12 has already been built in the top peripheral edge 11 when the container body 1 is formed. The peripheral structure of the cover 2 is also simple, with the nip portions 13, the cover 2 can be snapped onto the container body 1 to seal the open end 100. Hence, the structure of the die for forming the container 1 and the cover 2 will also be simple, and therefore, manufacturing and assembling cost will also be reduced.

2. the reinforced frame 12 is hidden in the top peripheral edge 11, leaving no clearance between the reinforced frame 12 and the top peripheral edge 11, the problem of the conventional food container that greasy dirt accumulates between the frame 93 and the engaging groove 901 can be avoided.

While we have shown and described various embodiments in accordance with the present invention, it is clear to those skilled in the art that further embodiments may be made without departing from the scope of the present invention.

What is claimed is:

1. A foldable food container comprising:

a container body being foldable and made of silicone material and formed with a receiving chamber which has an upper open end, a reinforced frame being built in a top peripheral edge of the open end of the container body, and on the top peripheral edge being provided at least one elastic nip portion;

a cover being engaged on the top peripheral edge and having a width larger than a width of the open end in such a manner that the reinforced frame is located below the peripheral edge of the cover, and the peripheral edge of the cover is engaged in the at least one nip portion of the top peripheral edge and pushed against the top peripheral edge of the container body by the at least one nip portion, so that the open end of the container body is sealed with the cover in an airtight manner;

wherein the at least one nip portion includes a root portion and a clamp piece, the root portion protrudes out of the top peripheral edge and provides an elasticity for pulling the clamp piece back when the clamp piece is pulled upward, the clamp piece horizontally extends from the root portion toward the open end, a space is formed between the clamp piece and the top peripheral edge for insertion of the cover, and the height of the space is smaller than the thickness of the cover, so that the cover will be pressed against the top peripheral edge when received in the space.

2. The foldable food container as claimed in claim 1, wherein an annular wall extends from a bottom of the cover and is formed to fit in the open end of the container body, the container body is provided adjacent the open end with an annular protrusion, and the annular protrusion protrudes toward the receiving chamber and is made of silicone material.

3. The foldable food container as claimed in claim 1, wherein the container body is rectangular, and at each of four corners of the top peripheral edge of the container body is formed one said nip portion.

* * * * *